US012655604B2

(12) United States Patent
Zacharias et al.

(10) Patent No.: US 12,655,604 B2
(45) Date of Patent: Jun. 16, 2026

(54) SHOULDERING BOARD ASSEMBLY

(71) Applicant: Soterran Group, LLC, Dakota Dunes, SD (US)

(72) Inventors: Chase Zacharias, Omaha, NE (US); Josh DeBoer, Gretna, NE (US)

(73) Assignee: Soterran Group, LLC., Dakota Dunes, SD (US)

( * ) Notice: Subject to any disclaimer, the term of this patent is extended or adjusted under 35 U.S.C. 154(b) by 477 days.

(21) Appl. No.: 18/296,701

(22) Filed: Apr. 6, 2023

(65) Prior Publication Data

US 2023/0323627 A1 Oct. 12, 2023

Related U.S. Application Data

(60) Provisional application No. 63/327,981, filed on Apr. 6, 2022.

(51) Int. Cl.
*E02F 3/815* (2006.01)

(52) U.S. Cl.
CPC ..... *E02F 3/8155* (2013.01)

(58) Field of Classification Search
CPC ..... E02F 3/8155
See application file for complete search history.

(56) References Cited

U.S. PATENT DOCUMENTS 2,594,727 A * 4/1952 Burggren ..... E02F 3/815 172/815
2,646,633 A 7/1953 Jahn
2,948,973 A * 8/1960 Magouirk ..... E02F 5/02 172/815
3,231,991 A * 2/1966 Wandscheer ..... E01H 5/065 37/232
3,279,104 A * 10/1966 Wandscheer ..... E01H 5/067 37/232
3,430,706 A 3/1969 Marron
3,680,451 A 8/1972 Birtchet
4,068,726 A * 1/1978 Heitman ..... E02F 3/815 172/815
6,463,683 B2 * 10/2002 Skwarchuk ..... E01H 5/066 37/274
7,051,819 B1 * 5/2006 Schenk ..... E02F 3/8152 172/784

(Continued)

OTHER PUBLICATIONS

International Search Report and the Written Opinion for PCT/US2023/017729, dated Jul. 20, 2023.

*Primary Examiner* — Matthew R Buck
(74) *Attorney, Agent, or Firm* — Ballard Spahr LLP

(57) ABSTRACT

A grading assembly for simultaneously grading a road and a shoulder is disclosed. The grading assembly can comprise a main moldboard that is elongate along a first longitudinal axis between a first end and a second end. The grading assembly can further comprise a shouldering moldboard that is elongate along a second longitudinal axis between a first end and a second end. A linkage can pivotably couple the shouldering moldboard to the main moldboard at the second end of the main moldboard so that the shouldering moldboard is movable relative to the main moldboard about and between a stowed position and a fully deployed position. An actuator can be configured to pivot the shouldering moldboard relative to the main moldboard by the linkage.

18 Claims, 16 Drawing Sheets

(56) References Cited

U.S. PATENT DOCUMENTS

| | | | | |
|---|---|---|---|---|
| 7,407,016 | B1 * | 8/2008 | Kvalo | E02F 3/8152<br>172/784 |
| 2007/0137872 | A1 * | 6/2007 | Ziebell | E02F 3/7636<br>172/699 |
| 2011/0311309 | A1 * | 12/2011 | Hartwich | E02F 3/8155<br>404/86 |

* cited by examiner

SHOULDERING BOARD ASSEMBLY

CROSS-REFERENCE TO RELATED APPLICATIONS

This application claims priority to and the benefit of the filing date of U.S. Provisional Patent Application No. 63/327,981, filed Apr. 6, 2022, the entirety of which is hereby incorporated by reference herein.

FIELD

This disclosure is generally related to devices and systems for grading earth.

BACKGROUND

Conventionally, when grading a road such as a gravel road or when preparing earth prior to paving, a tractor or other vehicle draws a blade across the road to shape a shoulder. As a secondary process, the same or another vehicle draws a blade across the road to shape the road surface. As can be understood, this at least doubles the time required to grade a road with a shoulder. Accordingly, a system for simultaneously grading a road and shoulder is desirable.

SUMMARY

Described herein, in one aspect, is a grading assembly comprising a main moldboard that is elongate along a first longitudinal axis between a first end and a second end. The grading assembly can further comprise a shouldering moldboard that is elongate along a second longitudinal axis between a first end and a second end. A linkage can pivotably couple the shouldering moldboard to the main moldboard at the second end of the main moldboard so that the shouldering moldboard is movable relative to the main moldboard about and between a stowed position and a fully deployed position. An actuator can be configured to pivot the shouldering moldboard relative to the main moldboard by the linkage.

DETAILED DESCRIPTION

Figure 1:
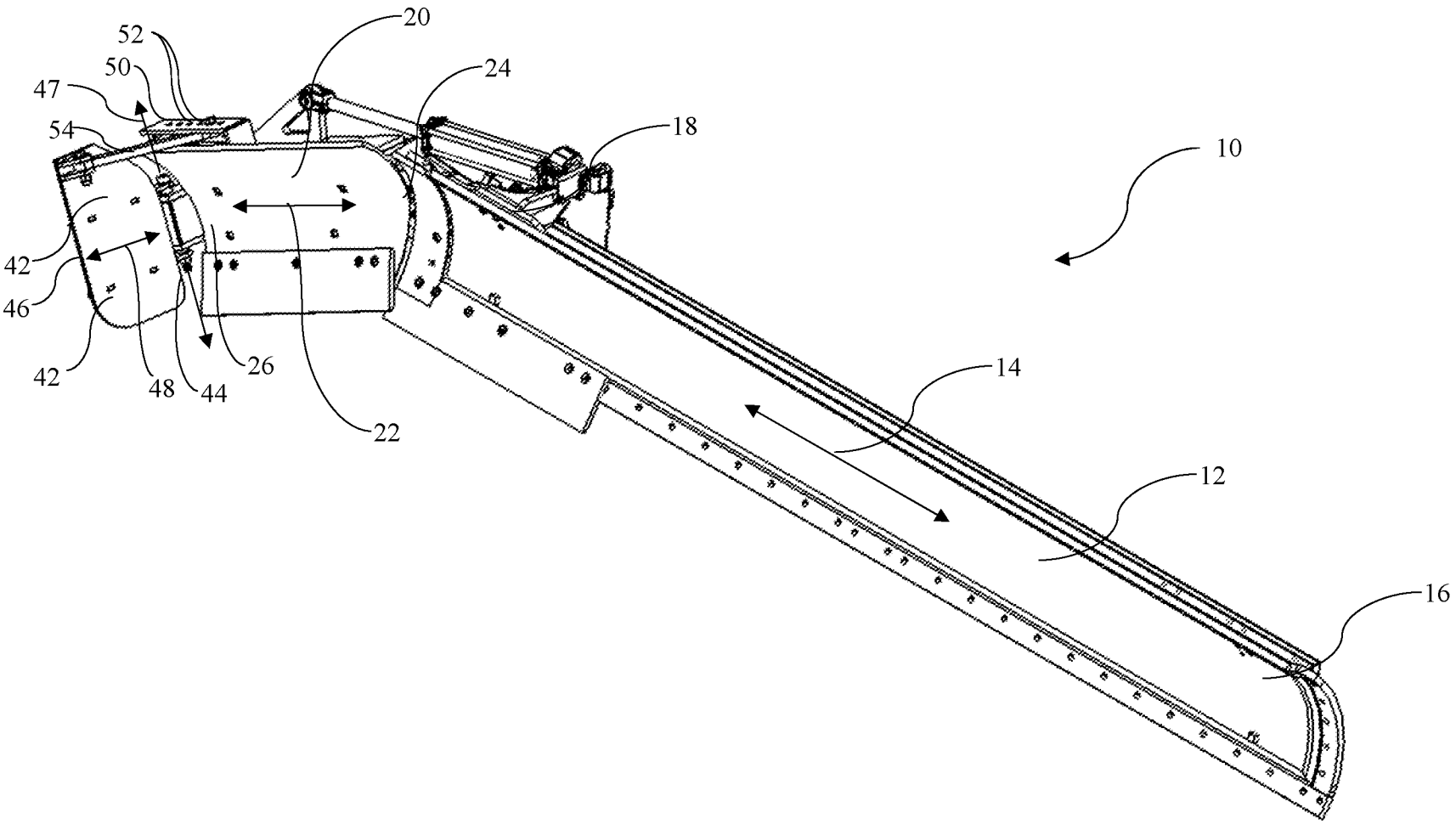
FIG. 1 is a front perspective view of a grading assembly as disclosed herein, with the grading assembly in a first configuration.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "an actuator" can refer to one or more of such actuators.

All technical and scientific terms used herein have the same meaning as commonly understood to one of ordinary skill in the art to which this invention belongs unless clearly indicated otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about" or "substantially," it is contemplated that values within up to 15%, up to 10%, up to 5%, or up to 1% (above or below) of the particularly stated value or characteristic can be included within the scope of those aspects.

As used herein, the terms "optional" or "optionally" mean that the subsequently described event or circumstance may or may not occur, and that the description includes instances where said event or circumstance occurs and instances where it does not.

The word "or" as used herein means any one member of a particular list and, except where otherwise indicated, can also include any combination of members of that list.

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry.

Disclosed herein, with reference to FIGS. 1-17, is a grading assembly 10 for simultaneously grading a road and a shoulder. With reference to FIG. 1, the grading assembly 10 can comprise a main moldboard 12 that is elongate along a first longitudinal axis 14 between a first end 16 and a second end 18. A shouldering moldboard 20 can couple to the main moldboard 12. The shouldering moldboard 20 can be elongate along a second longitudinal axis 22 between a first end 24 and a second end 26. The shouldering moldboard 20 can couple to the main moldboard 12 so that the second end 18 of the main moldboard 12 is adjacent to the first end 24 of the shouldering moldboard 20.

Figure 2:
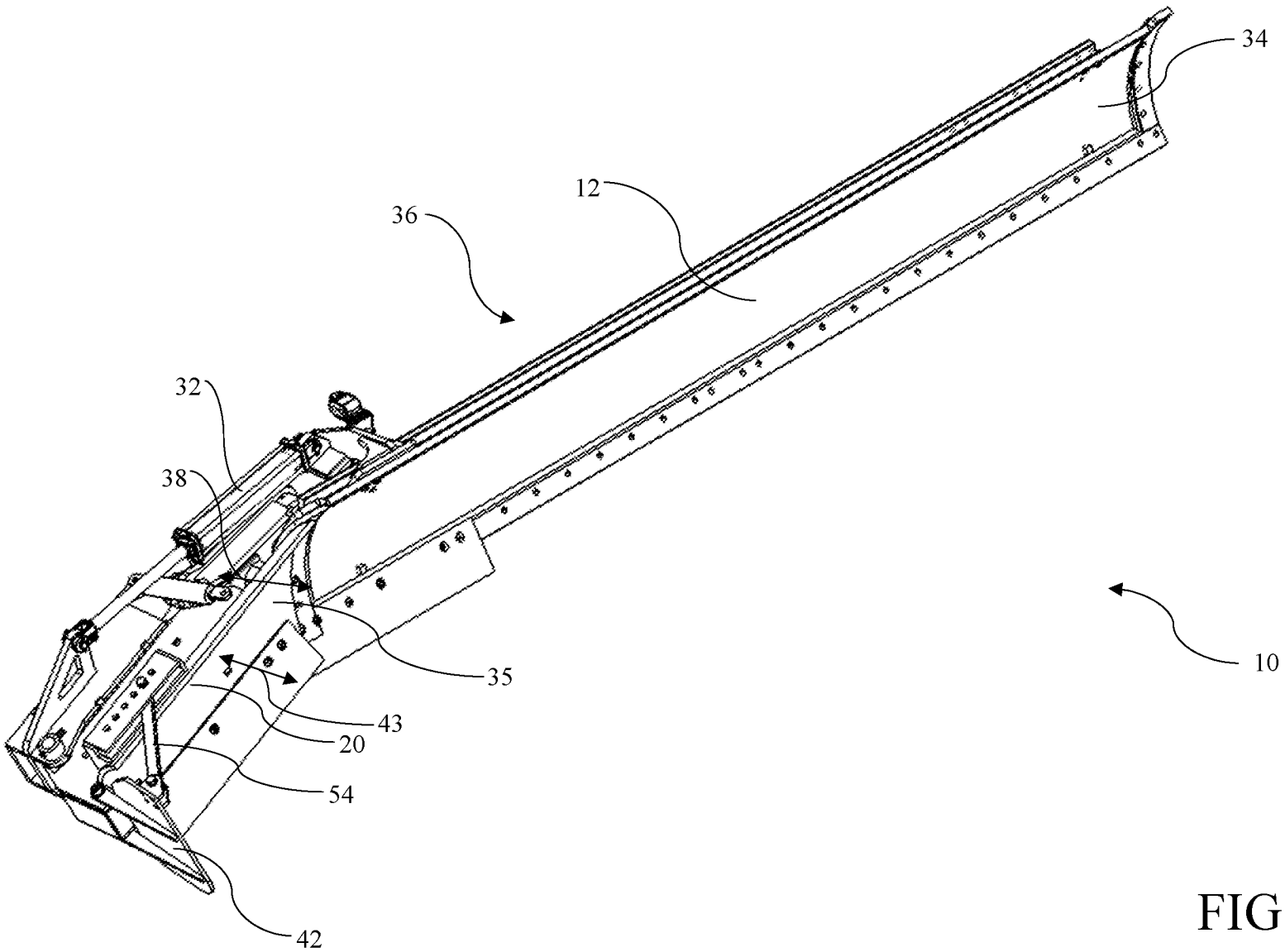
FIG. 2 is a side perspective view of the grading assembly of FIG. 1.
Figure 3:
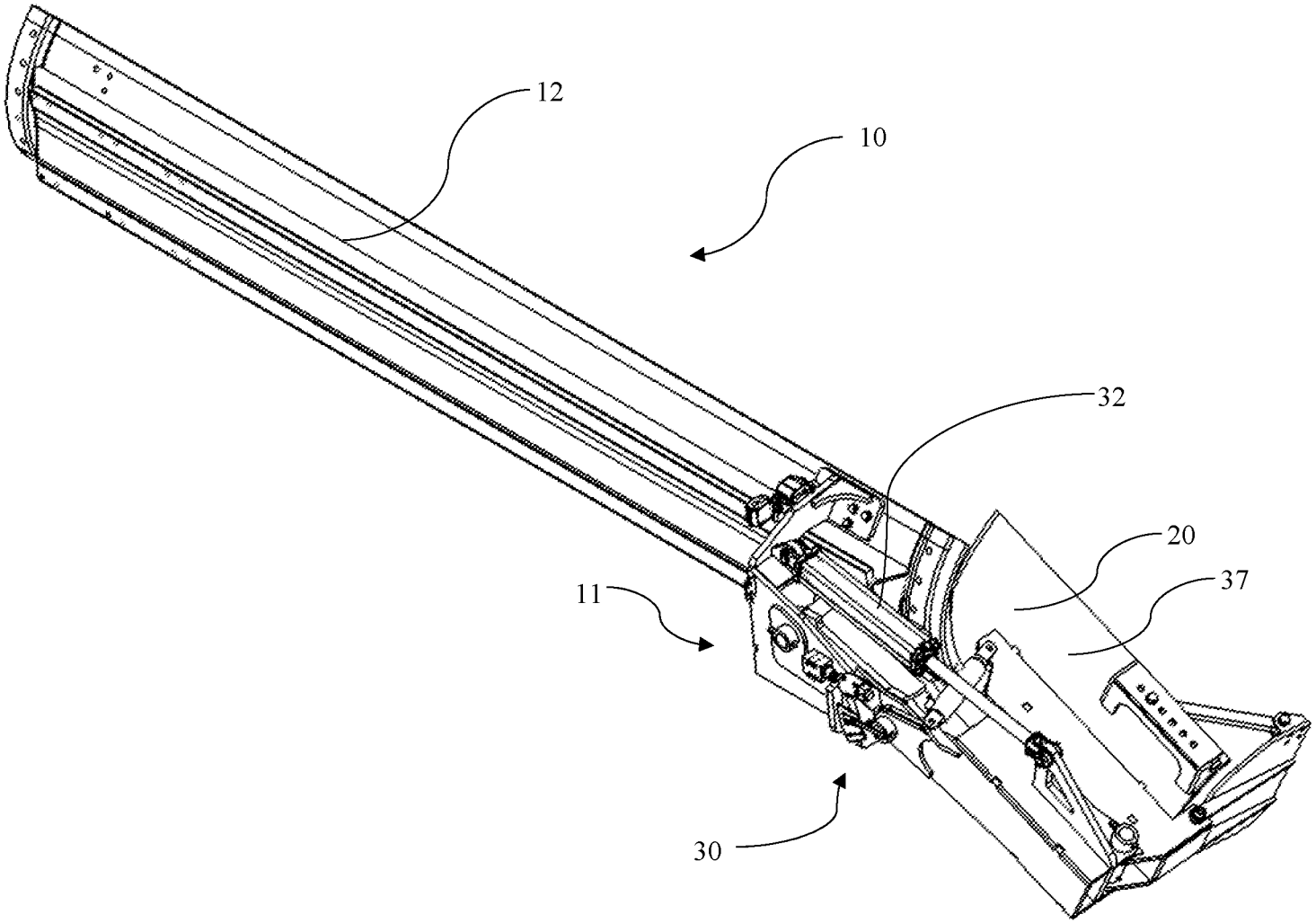
FIG. 3 is a rear perspective view of the grading assembly of FIG. 1.

Referring also to FIGS. 2-3, a linkage 30 can couple the shouldering moldboard 20 to the main moldboard 12. The linkage 30 can enable the shouldering moldboard 20 to move relative to the main moldboard 12 about and between a stowed (raised) position (FIGS. 7-10) and a fully deployed (lowered) position (FIGS. 1-3). An actuator 32 can be configured to move the shouldering moldboard 20 relative to the main moldboard 12 by the linkage 30. The actuator 32 can be a linear actuator. For example, the actuator 32 can be a hydraulic cylinder. In further aspects, the actuator 32 can be an electric linear actuator. More generally, it is contemplated that the actuator 32 can comprise any structure that is capable of directly or indirectly imparting motion to the shouldering moldboard 20 (optionally, via application of force to the linkage 30). The linkage 30 can comprise a bracket 58 that couples to the main moldboard 12.

Figure 11:
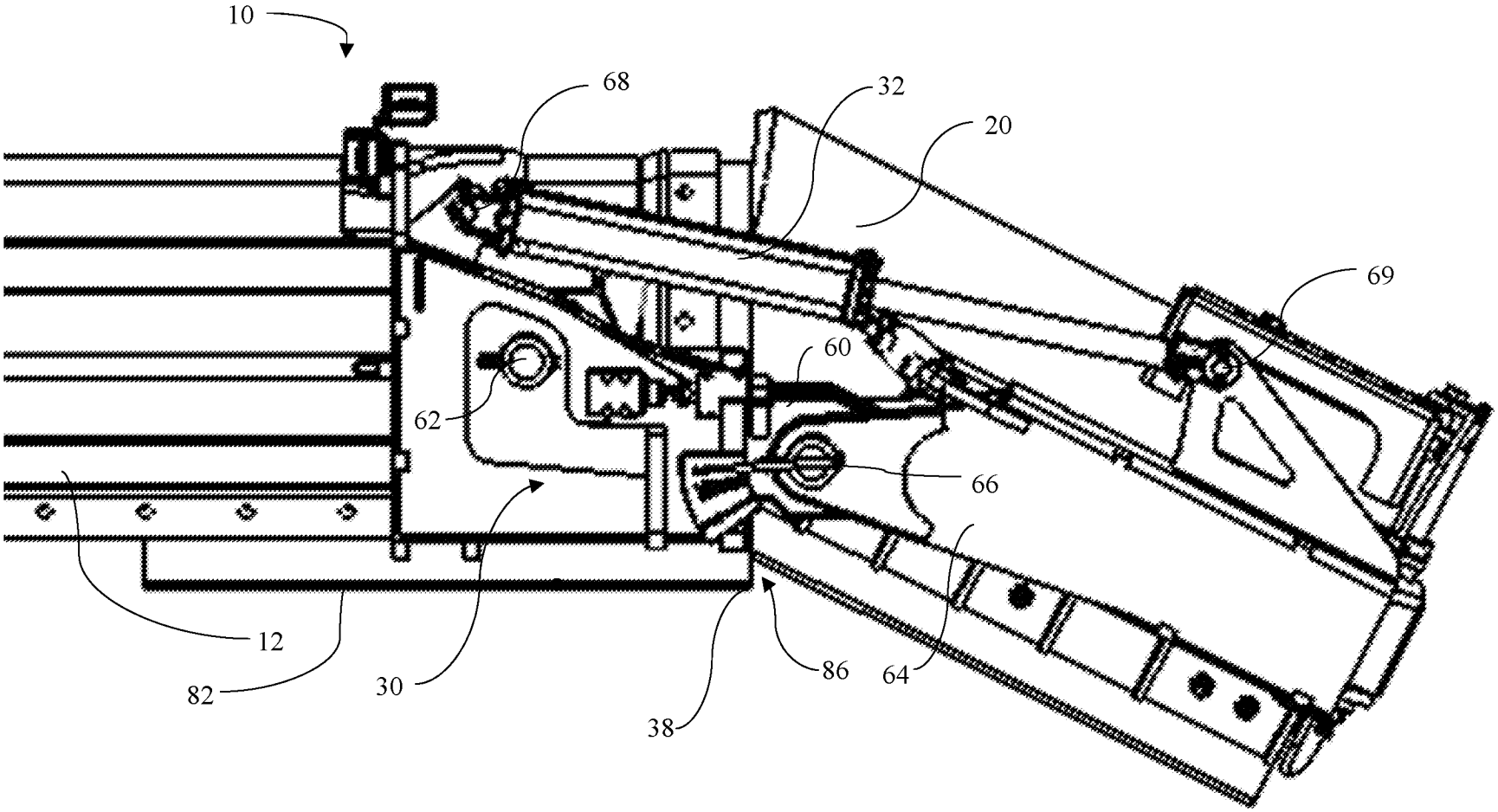
FIG. 11 is a partial rear view of the grading assembly of FIG. 1 in the first configuration.
Figure 12:
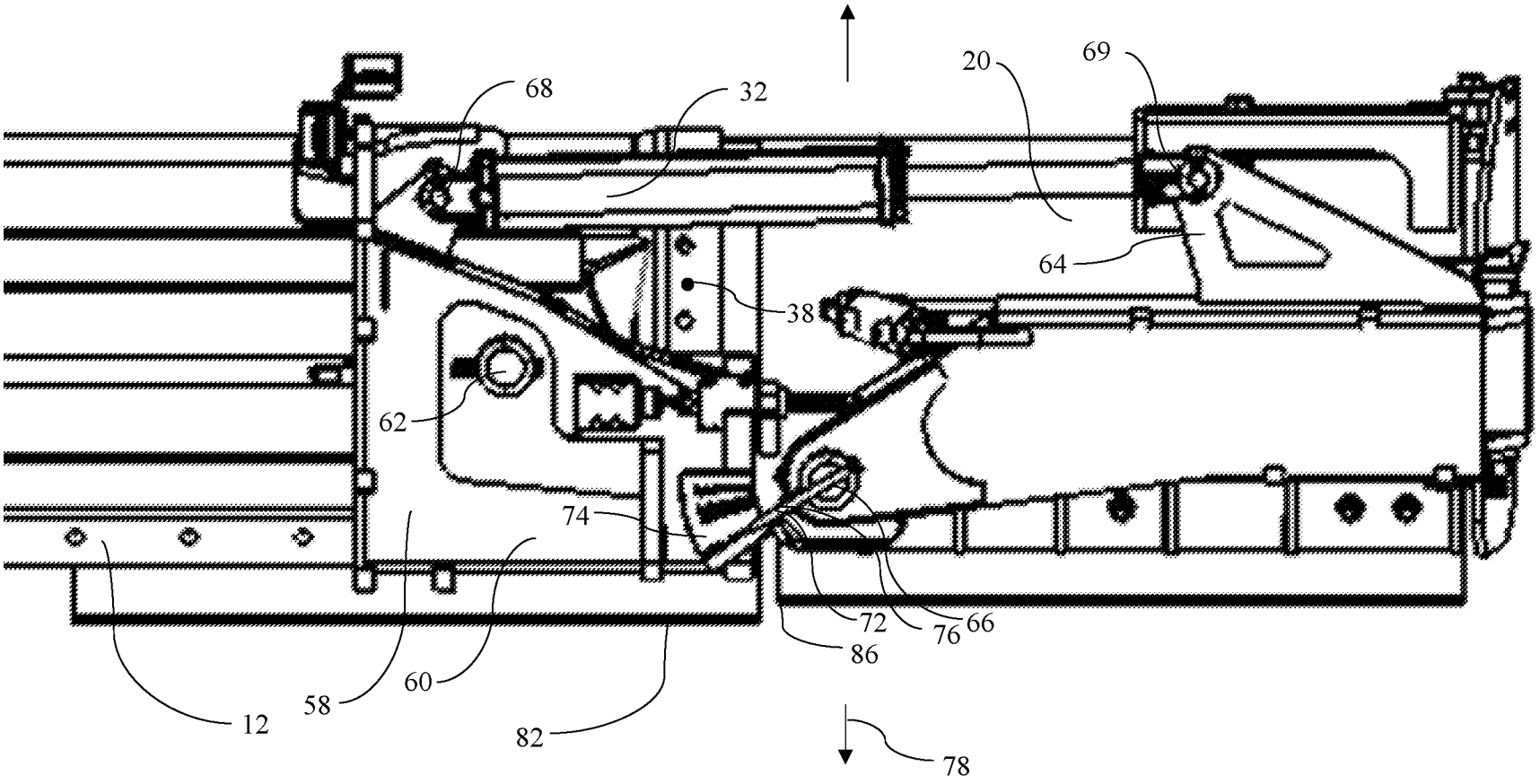
FIG. 12 is a partial rear view of the grading assembly of FIG. 1 in the second configuration.
Figure 13:
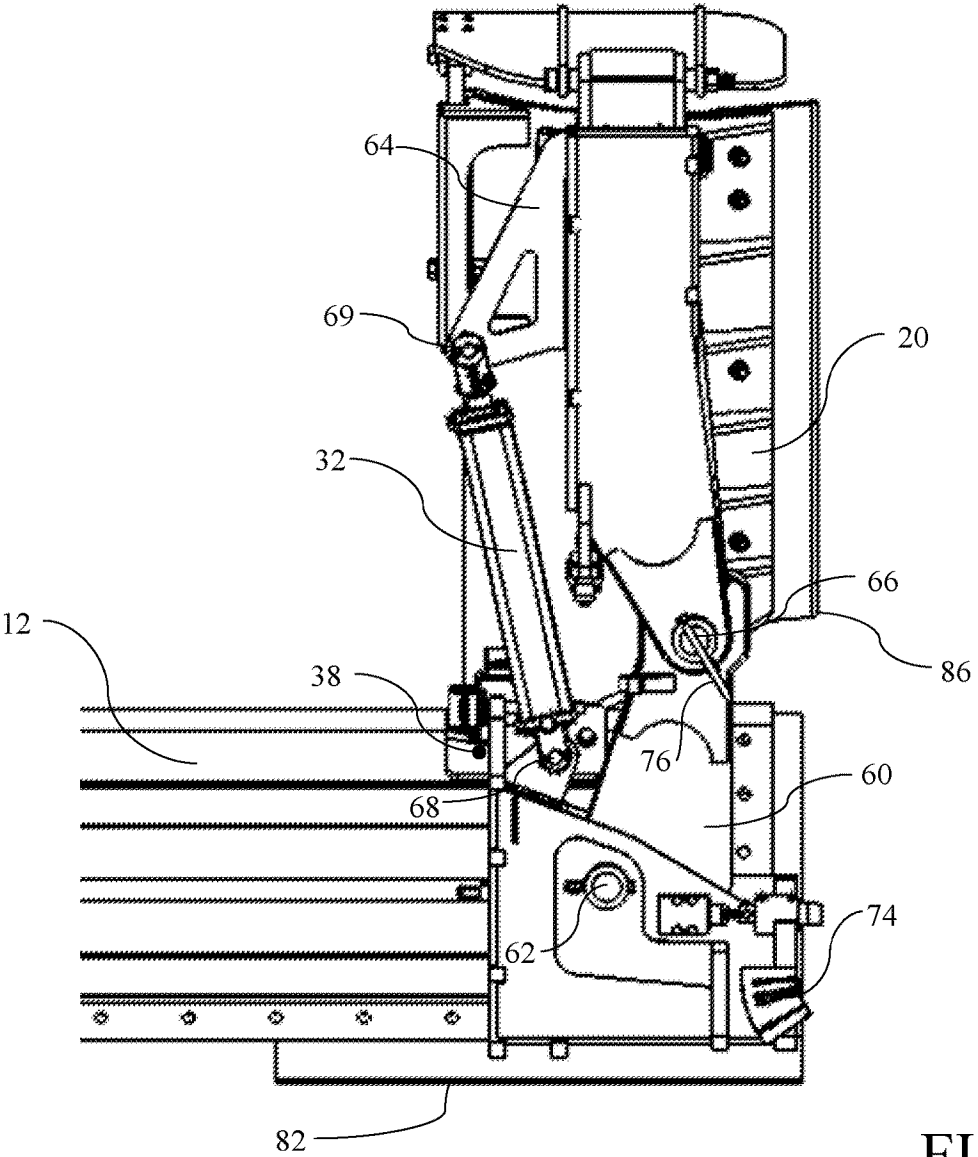
FIG. 13 is a partial rear view of the grading assembly of FIG. 1 in the third configuration.
Figure 14:
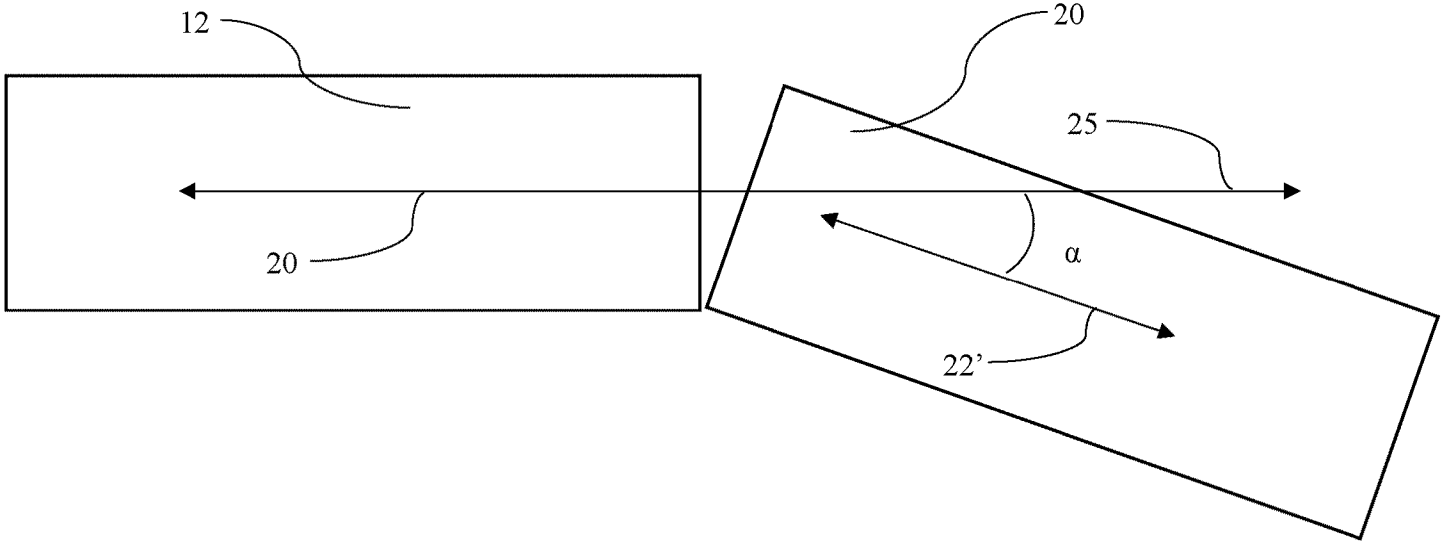
FIG. 14 is a schematic rear view of the grading assembly, illustrating angular orientation of the main moldboard relative to the shouldering moldboard.
Figure 15A:
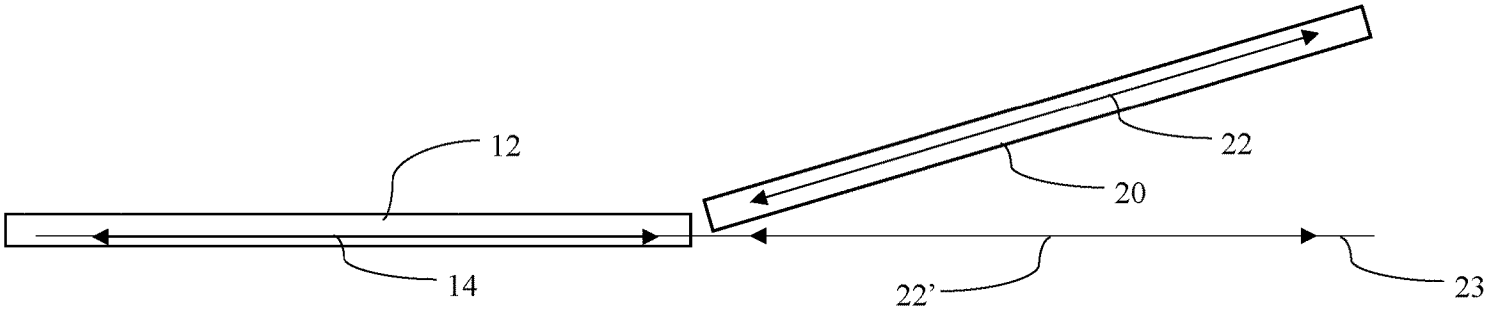
FIG. 15A is a schematic top view of the grading assembly, illustrating an exemplary angular orientation of the main moldboard relative to the shouldering moldboard, showing an exaggerated angular offset between the main moldboard and the shouldering moldboard.
Figure 15B:
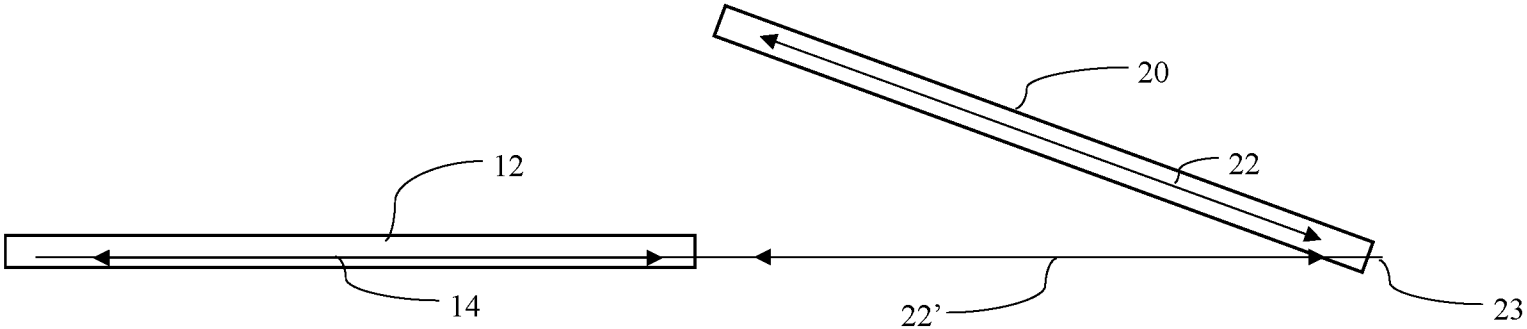
FIG. 15B is a schematic top view of the grading assembly, illustrating another exemplary angular orientation of the main moldboard relative to the shouldering moldboard, with the shouldering moldboard shifted relative to the main moldboard before moving the shouldering moldboard to a stowed position to inhibit interference between the main moldboard and the shouldering moldboard.

The main moldboard 12 can have a front face 34 and an opposed rear face 36. A front-to-rear axis 38 can be perpendicular to the first longitudinal axis 14 and can extend through the main moldboard 12 between the front face 34 and the opposed rear face 36. Referring to FIGS. 11-13, in at least one position between (and including) the stowed (raised) position and the fully lowed position, the front-to-rear axis 38 can extend through the main moldboard 12 and the shouldering moldboard 20. For example, the front-to-rear axis 38 can extend through both the main moldboard 12 and the shouldering moldboard 20 with the shouldering moldboard in the fully deployed (lowered) position. At least a portion of the shouldering moldboard 20 can overlap with the main moldboard 12 along the first longitudinal axis 14.

Figure 4:
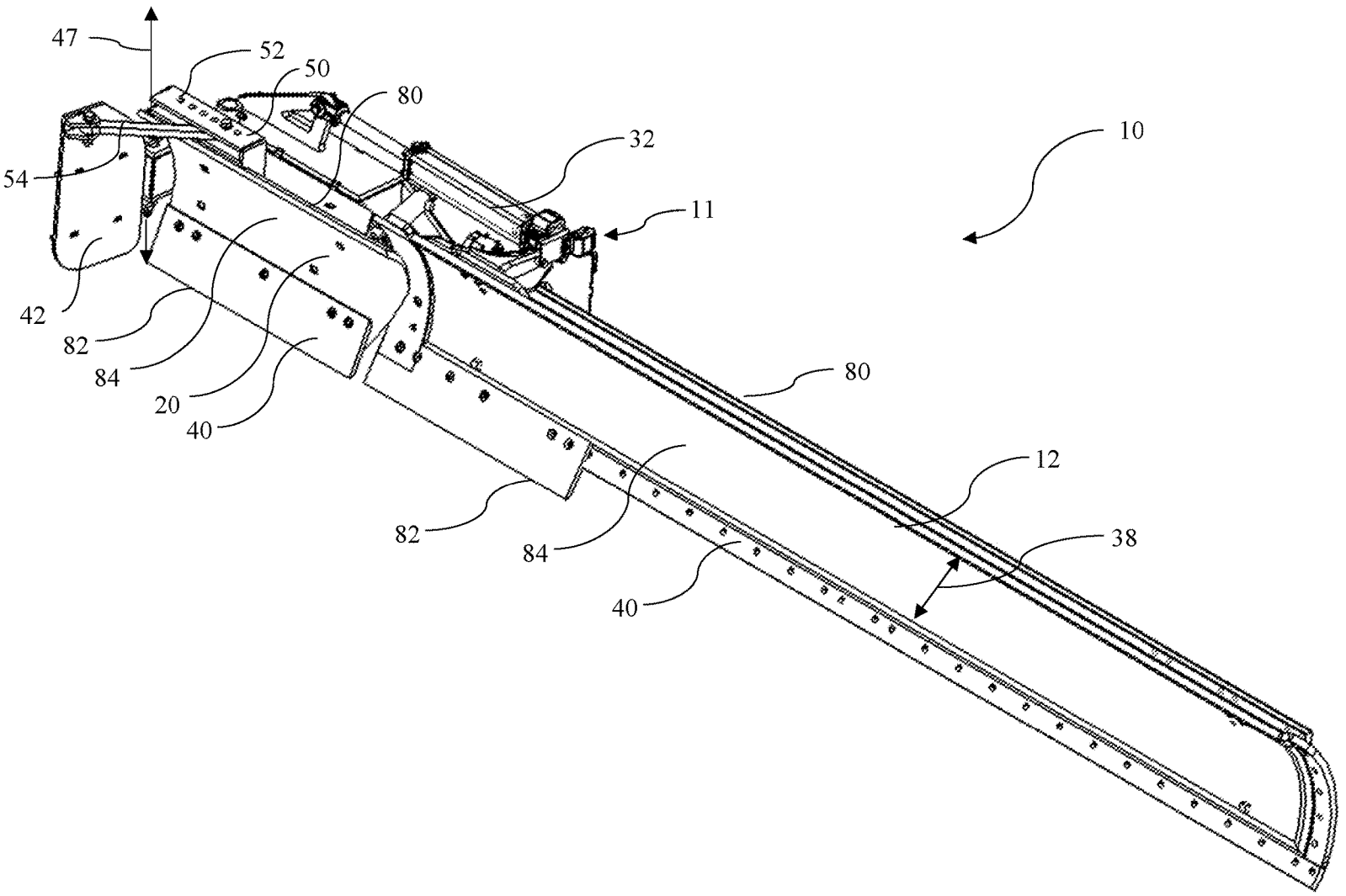
FIG. 4 is a front perspective view of the grading assembly of FIG. 1 in a second configuration.

One or both of the main and shouldering moldboards 12, 20 can have respective front faces 34, 35 that are concave in a forward direction (e.g., curved about axes that are parallel to their respective first and second longitudinal axes 14, 22). For example, referring to FIG. 4, upper and lower edges 80, 82 of a moldboard can be spaced apart relative to a vertical axis, and relative to the front-to-rear axis 38, the upper and lower edges of the moldboard can be positioned forward of an intermediate portion 84 of the moldboard that is positioned vertically between the upper and lower edges 80, 82. As shown in FIG. 4, one or both of the main and shouldering moldboards 12, 20 can comprise blades 40 that are positioned at their lower ends and are configured to engage the ground. The blades 40 can be configured for removal and replacement. For example, the blades 40 can be coupled to the rest of the respective moldboards via fasteners such as screws, rivets, etc. Although the blade 40 of the main moldboard 12 is illustrated as extending only a portion of the length of the main moldboard, it is contemplated that said blade can extend an entirety, or substantially an entirety, of the length of the main moldboard. In further aspects, it is contemplated that the blade 40 can extend beyond an entire length of the main moldboard 12.

Referring to FIG. 1, an end plate 42 can be coupled to the shouldering moldboard 20 and can extend forwardly from the second end 26 of the shouldering moldboard 20 along an axis 43 that is perpendicular to the second longitudinal axis 22 and extends through the thickness of the shouldering moldboard between the front face 35 and a rear face 37 (FIG. 3) of the shouldering moldboard. The end plate can have a proximal end 44 and a distal end 46 that are spaced along an end plate axis 48. In some aspects, the end plate can be selectively configurable to extend at a select angle (e.g., from about 0 degrees to about 60 degrees, from about 15 degrees to about 60 degrees, from about 0 degrees to about 45 degrees, from about 15 degrees to about 45 degrees, or from about 30 degrees to about 45 degrees) relative to the second longitudinal axis 22 of the shouldering moldboard 20. For example, as shown in FIG. 4, in some optional aspects, the end plate can pivotably couple to the shouldering moldboard 20 about a pivotal axis 47. An adjustment bracket 50 can extend along a portion of the length of the main moldboard. The adjustment bracket 50 can define a plurality of holes 52 that are spaced along the first longitudinal axis 14. An arm 54 can couple to the end plate 42 at a position spaced from the pivotal axis 47 of the end plate and can couple to the adjustment bracket 50 at a select hole 52 (e.g., via a clevis pin or other fastener). It is contemplated that the end plate 42 can be oriented so that the end plate axis 48 (FIG. 2) extends parallel to, or substantially parallel to (e.g., within 20 degrees, within 10 degrees, within 5 degrees, or within 1 degree of parallel to) the direction of travel of the grading assembly 10.

Figure 16:
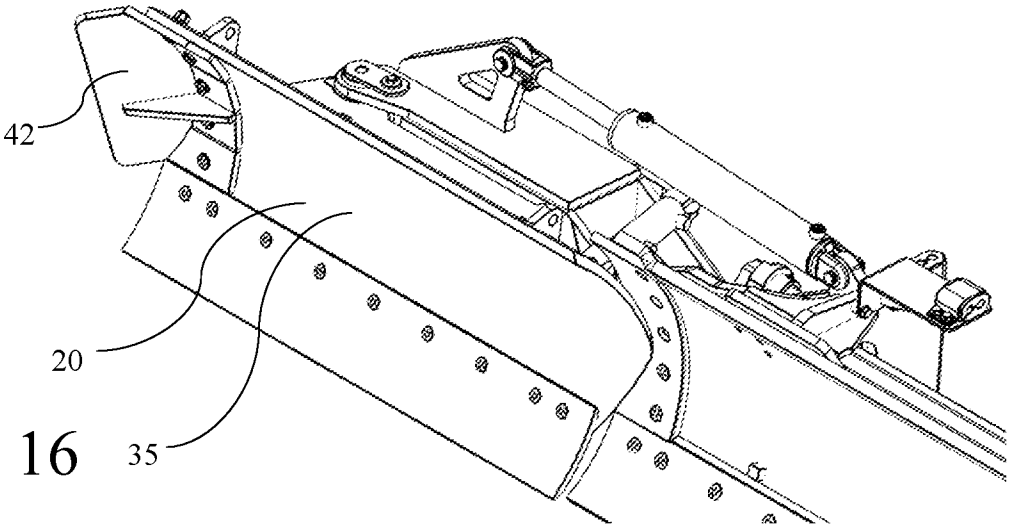
FIG. 16 is a partial rear front view of an exemplary grading assembly as disclosed herein, with an end plate extending forwardly from the shouldering moldboard.
Figure 17:
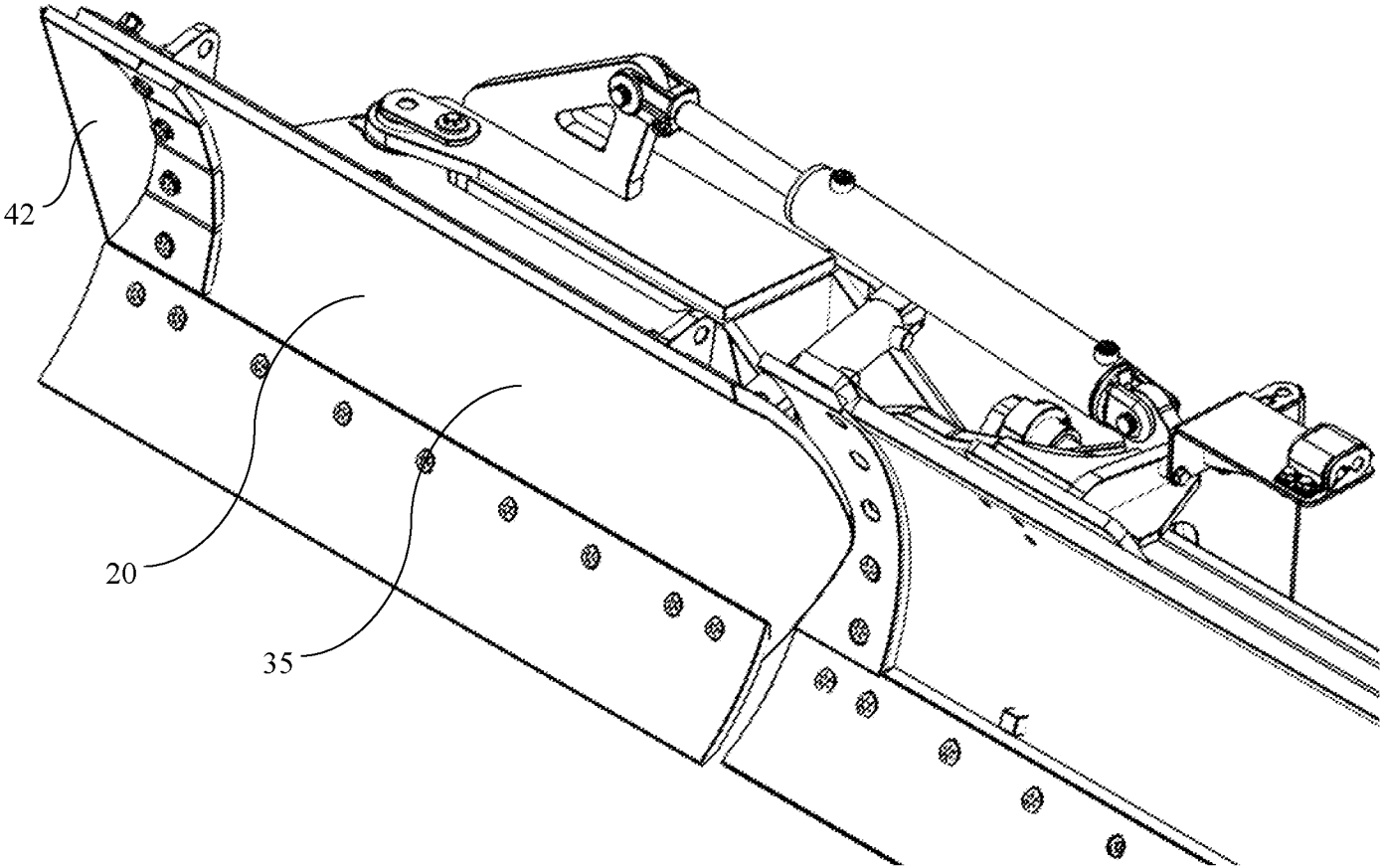
FIG. 17 is a partial rear front view of an exemplary grading assembly as disclosed herein, with an end plate extending parallel to the shouldering moldboard.

Referring also to FIGS. 16 and 17, in some optional aspects, the end plate 42 can be non-pivotably coupled to the shouldering moldboard 20. For example, the end plate 42 can fixedly couple to the front face 35 of the shouldering moldboard 20 via fasteners. The end plate 42 can extend outwardly from the shouldering moldboard. As shown in FIG. 16, the end plate 42 can extend forwardly from the shouldering moldboard 20 (e.g., forming an obtuse angle between the shouldering moldboard and the end plate). Optionally, as shown, the end plate 42 can comprise one or more supporting structures (e.g., a bracket, arm, strut, truss, beam, reinforcement member, fin, or the like) that extend between the end plate and the shouldering moldboard to provide additional support to the angularly oriented end plate 42 (in addition to the fasteners). As shown in FIG. 17, in other aspects, the end plate 42 can extend parallel to, or generally parallel to, the shouldering moldboard 20. Optionally, as shown, the end plate 42 may be fully supported by the fasteners that fixedly couple the end plate to the front face 35 of the shouldering moldboard 20 such that no additional supporting structure is required. In some aspects, the end plate 42 can be removed and replaced, depending on the desired configuration relative to the shouldering moldboard 20. For example, it is contemplated that end plates of various sizes can be selectively coupled to the shouldering moldboard 20 to modify the configuration of the assembly.

Figure 6:
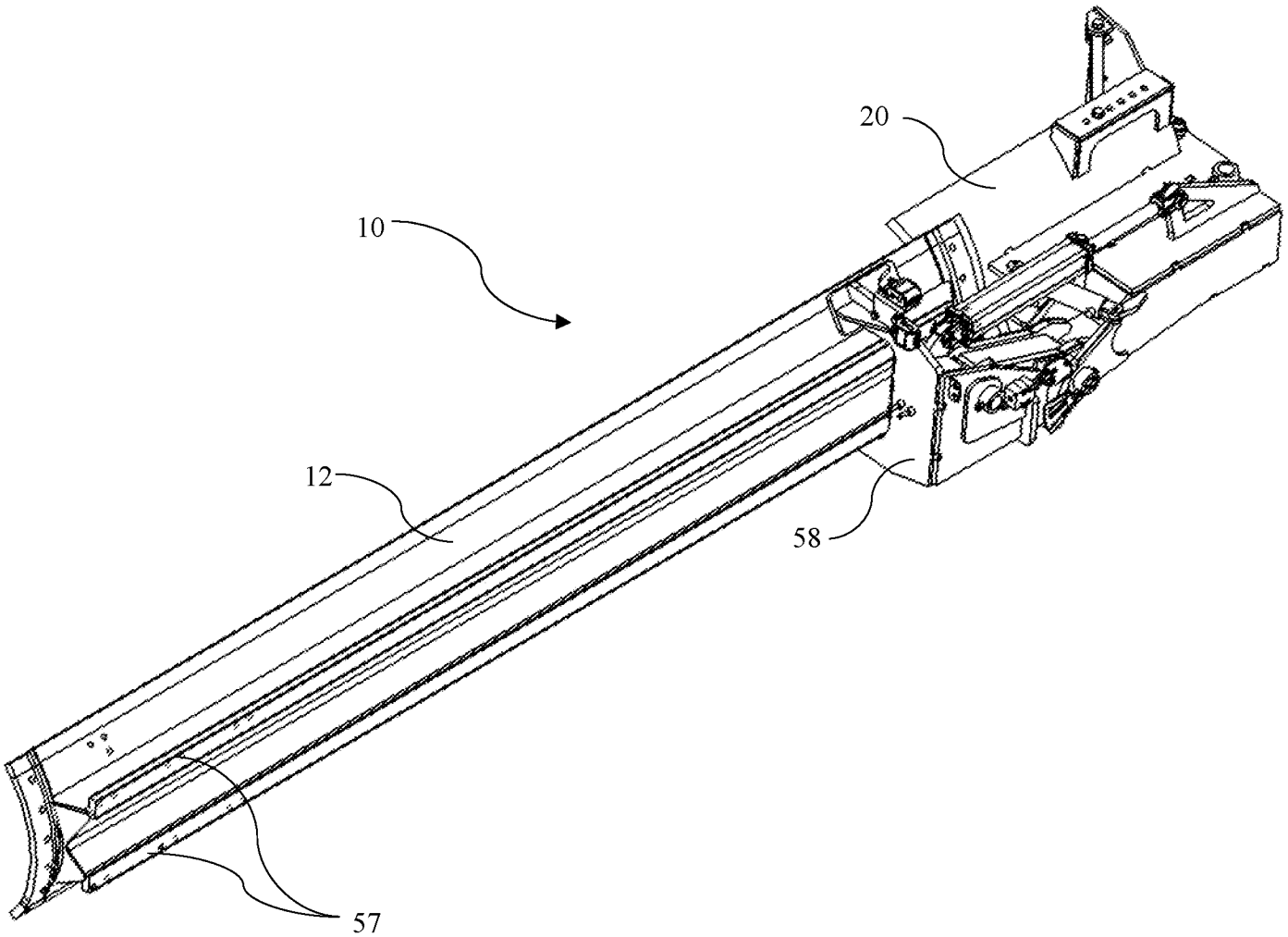
FIG. 6 is an end view of the grading assembly of FIG. 4.
Figure 7:
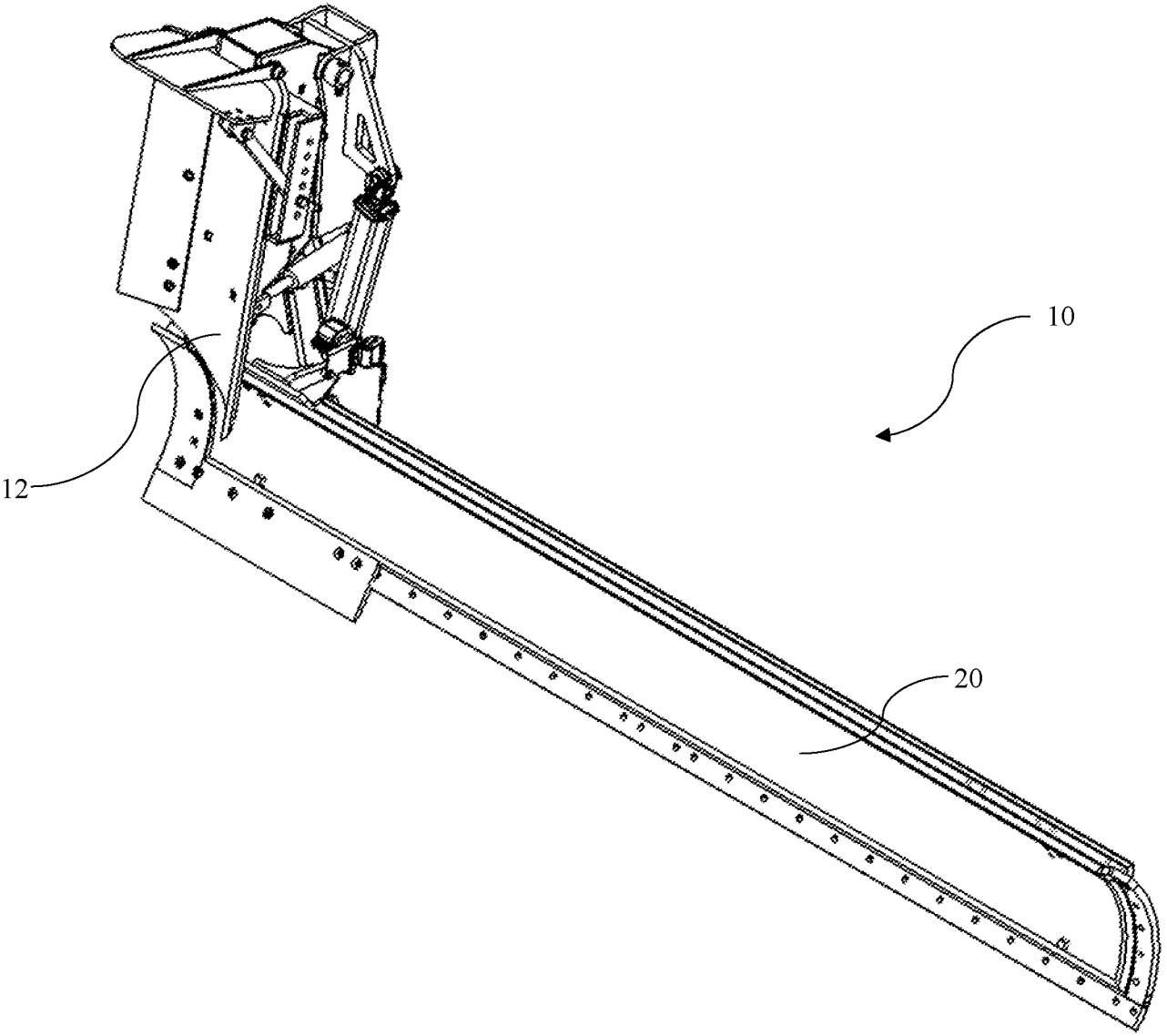
FIG. 7 is a front perspective view of the grading assembly of FIG. 1 in a third (raised, stowed) position.

Referring to FIG. 6, the main moldboard 12 can comprise a pair of rails 57 that extend along the rear face 36. The rails 57 can be used to couple the grading assembly 10 to a vehicle. The rails 57 can enable adjustable positioning of the grading assembly 10 relative to the vehicle along the longitudinal axis 14.

Referring to FIGS. 11-13, the linkage 30 can be configured to enable movement of the shouldering moldboard 20 relative to the main moldboard 12 to stow the shouldering moldboard above the main moldboard (or above a lower edge of the main moldboard). In some aspects, the linkage 30 can be configured to enable movement of the shouldering moldboard 20 relative to the main moldboard 12 while inhibiting a lower proximal corner 86 of the shouldering moldboard from extending substantially below the lower edge 82 of the main moldboard. The grading assembly 10 can comprise a stop 70 (FIG. 9) that engages the linkage 30 between the stowed (raised) position and the fully deployed (lowered) position to restrict movement of at least a portion of the linkage. It is contemplated that the stop 70 can be defined by a receptacle 71 (FIG. 9) that transfers forward force to the shouldering moldboard 20, through the first arm 60.

Figure 9:
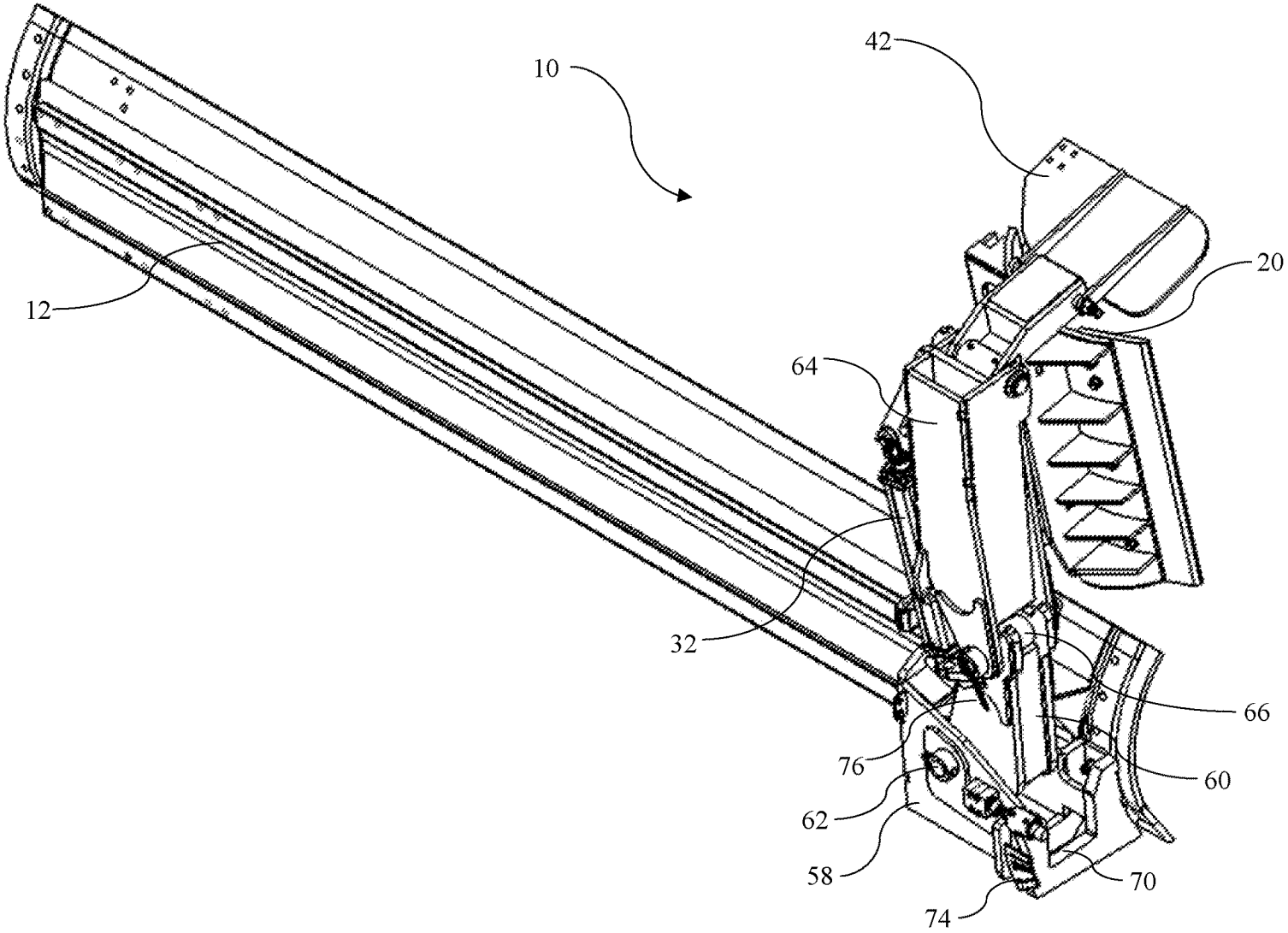
FIG. 9 is a rear view of the grading assembly of FIG. 7.

Referring also to FIG. 9, the linkage 30 can comprise a first arm 60 that is pivotable relative the main moldboard 12 about a first pivotal axis 62. For example, the first arm 60 can pivotably couple to the bracket 58. A second arm 64 can be pivotable relative to the first arm 60 about a second pivotal axis 66 that is spaced from the first pivotal axis 62 along the first arm 60.

In some aspects, the actuator 32 can be a linear actuator that pivotably couples to the main moldboard 12 (e.g., via the bracket 58) about a third pivotal axis 68 and pivotably couples to the second arm 64 about a fourth pivotal axis 69 that is spaced from the second pivotal axis 66 along the second arm.

Figure 5:
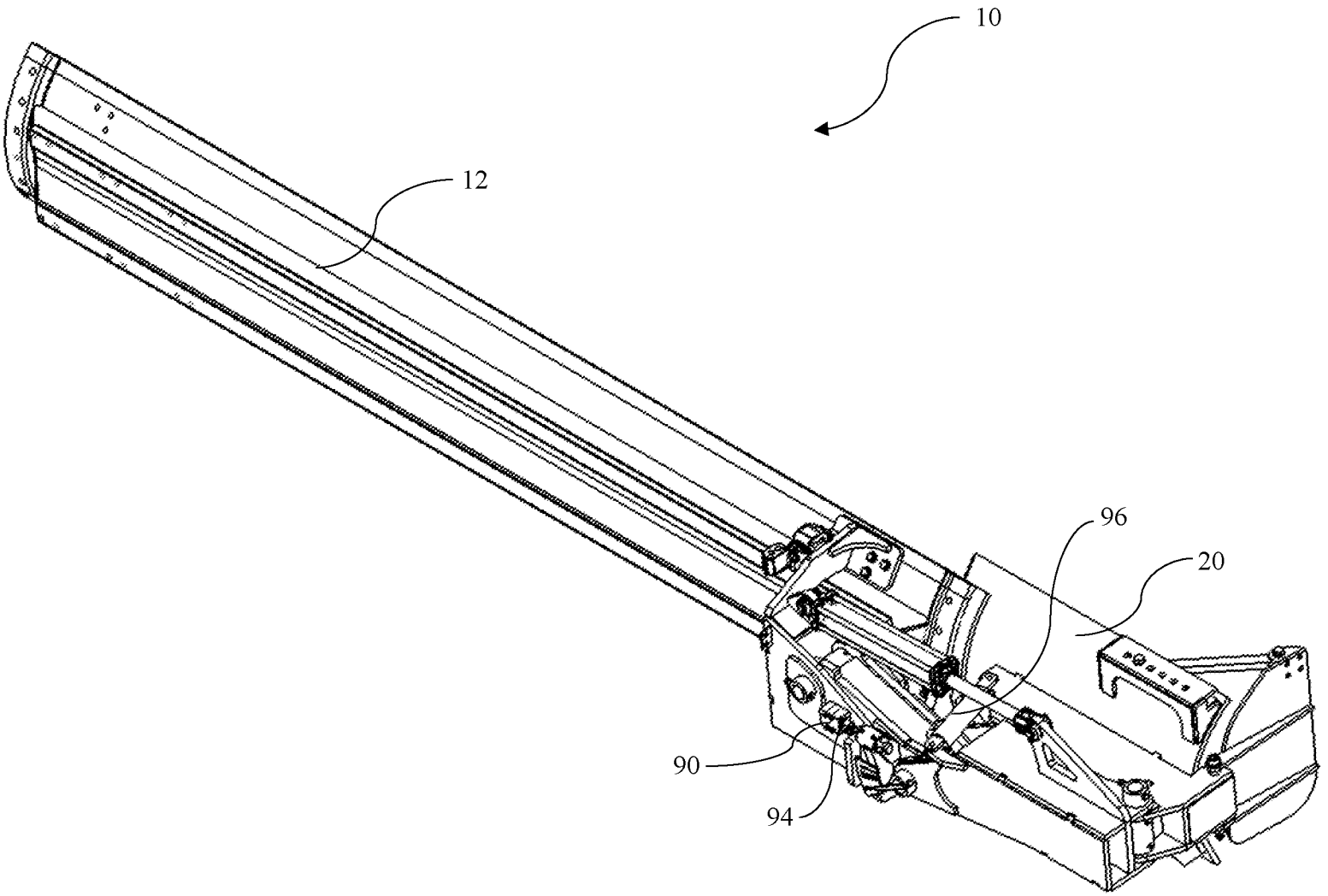
FIG. 5 is a rear view of the grading assembly of FIG. 4.
Figure 10:
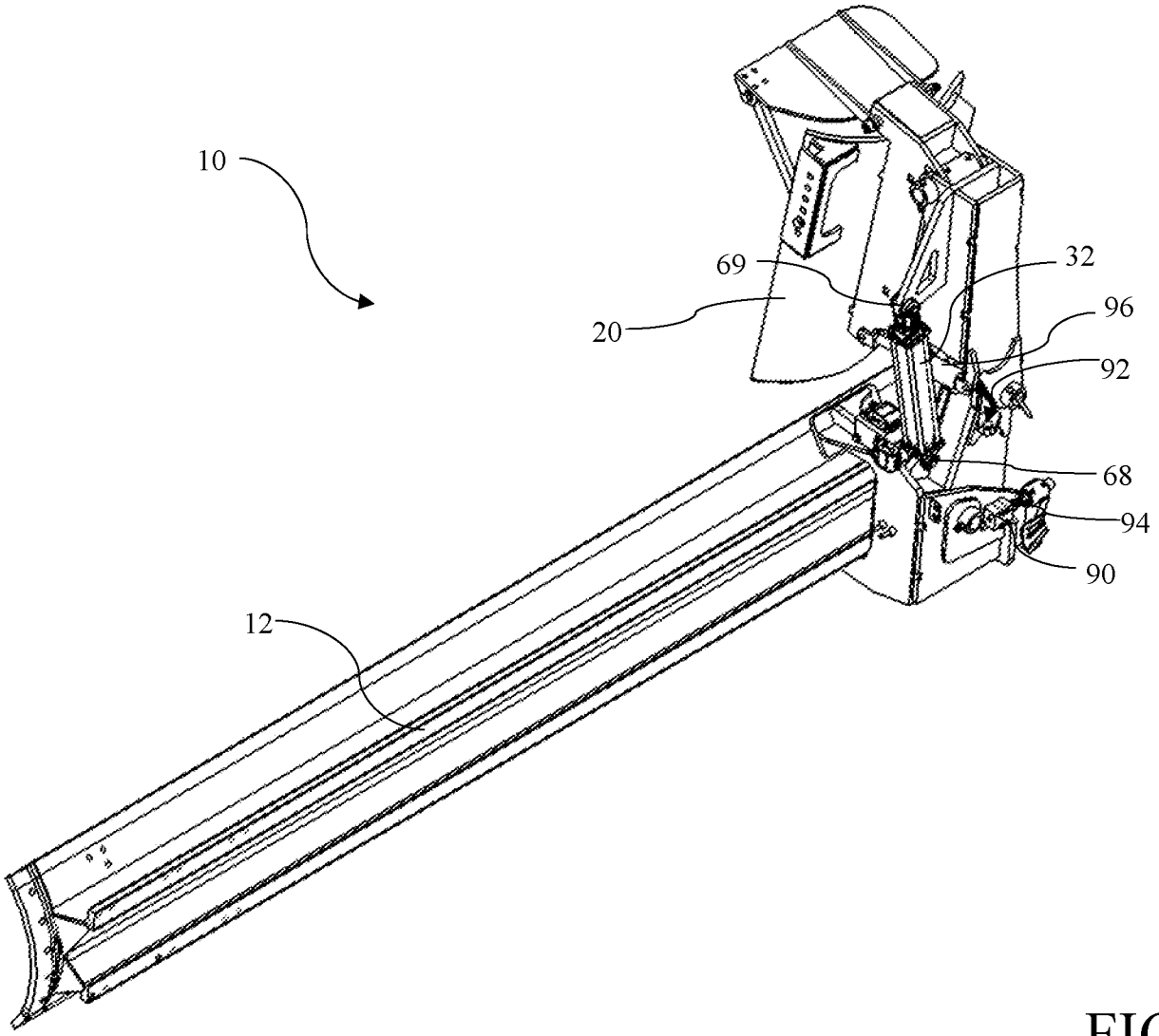
FIG. 10 is a second end view of the grading assembly of FIG. 7.

Referring to FIGS. 5 and 10, a locking pin 90 can be configured to extend through an opening 92 of the first arm 60 when the first arm is received within the receptacle 71 in order to retain the first arm within the receptacle. In some aspects, the locking pin 92 can be actuated by an actuator 94, such as, for example, a solenoid or a pneumatic or hydraulic cylinder. In these aspects, an operator control device, such as, for example, a switch in communication with the actuator 74, can enable an operator to move the locking pin 90 about and between a locking position, in which the locking pin extends through the opening 92, and an unlocked position, in which the locking pin is retracted from the opening. In further aspects, the actuator 94 can be actuated in response to a condition. For example, the actuator 94 can be configured to actuate to move the locking pin to the locked position upon a sensor detecting that the first arm is fully received within the receptacle, and the actuator can be configured to actuate to move the locking pin to the unlocked position upon receiving a signal (e.g., an operator-triggered signal) indicating that the shouldering moldboard is to move to the stowed position. Suitable sensors for detecting receipt of the first arm within the receptacle include, for example and without limitation, proximity sensors (e.g., optical proximity sensors), position encoders (e.g., absolute, incremental, linear, or rotary encoders), displacement sensors, inductive sensors, linear variable differential transformers (LVDTs), or combinations thereof.

As further described herein and with reference to FIGS. 8 and 12, and 14-15B, in some aspects, the shouldering moldboard 20 can be adjustably pivoted relative to the main moldboard 12 about a pivotal axis 78 for changing an angle at which the shouldering moldboard 20 extends forwardly or rearwardly from the main moldboard (e.g., into and out of the page as shown in the view in FIG. 12). As can be understood, pivotal position about this axis does not affect the angle between a road surface and a shoulder formed by moving the grading assembly 10 during grading. Accordingly, as described herein, reference to angles of axes projected into planes can allow for determining the angle of the first longitudinal axis 14 of the main moldboard 12 relative to the second longitudinal axis 22 of the shouldering moldboard 20, which can correspond to the angle, a, formed between a road and a shoulder by use of the grading assembly 10 (i.e., moving the grading assembly 10 against the ground surface along the direction of travel of the grading assembly). For example, a projection 22' of the second longitudinal axis 22 into a vertical plane 23 that includes the first longitudinal axis 14 can correspond to the angle, a, formed between a road and a shoulder by use of the grading assembly 10.

The stop 70 can engage the first arm 60 to cease rotation of the first arm as the shouldering moldboard 20 moves from the stowed (raised) position to the fully deployed (lowered) position. Thus, the first arm 60 can enable movement of the shouldering moldboard 20 outwardly from the main moldboard (e.g., along the first longitudinal axis 14) until the first arm 60 engages the stop 70. Optionally, when the first arm 60 engages the stop 70, the shouldering moldboard 20 is generally parallel to the main moldboard 12, as illustrated in FIGS. 4-6. For example, with the main moldboard 12 (and first longitudinal axis 14) extending horizontally, the shouldering moldboard 20 (and second longitudinal axis 22) can likewise be horizontal, but can optionally be pivoted relative to the main moldboard about a vertical axis. Thus, the first longitudinal axis 14 can be parallel to or aligned with a projection of the second longitudinal axis 22 onto a vertical plane that includes the first longitudinal axis. In exemplary aspects, the stop 70 can engage the first arm when the second longitudinal axis 22 is within plus or minus 10 degrees of a plane 25 (FIG. 14) that includes the first longitudinal axis 14 and the front-to-rear axis 38.

Figure 8:
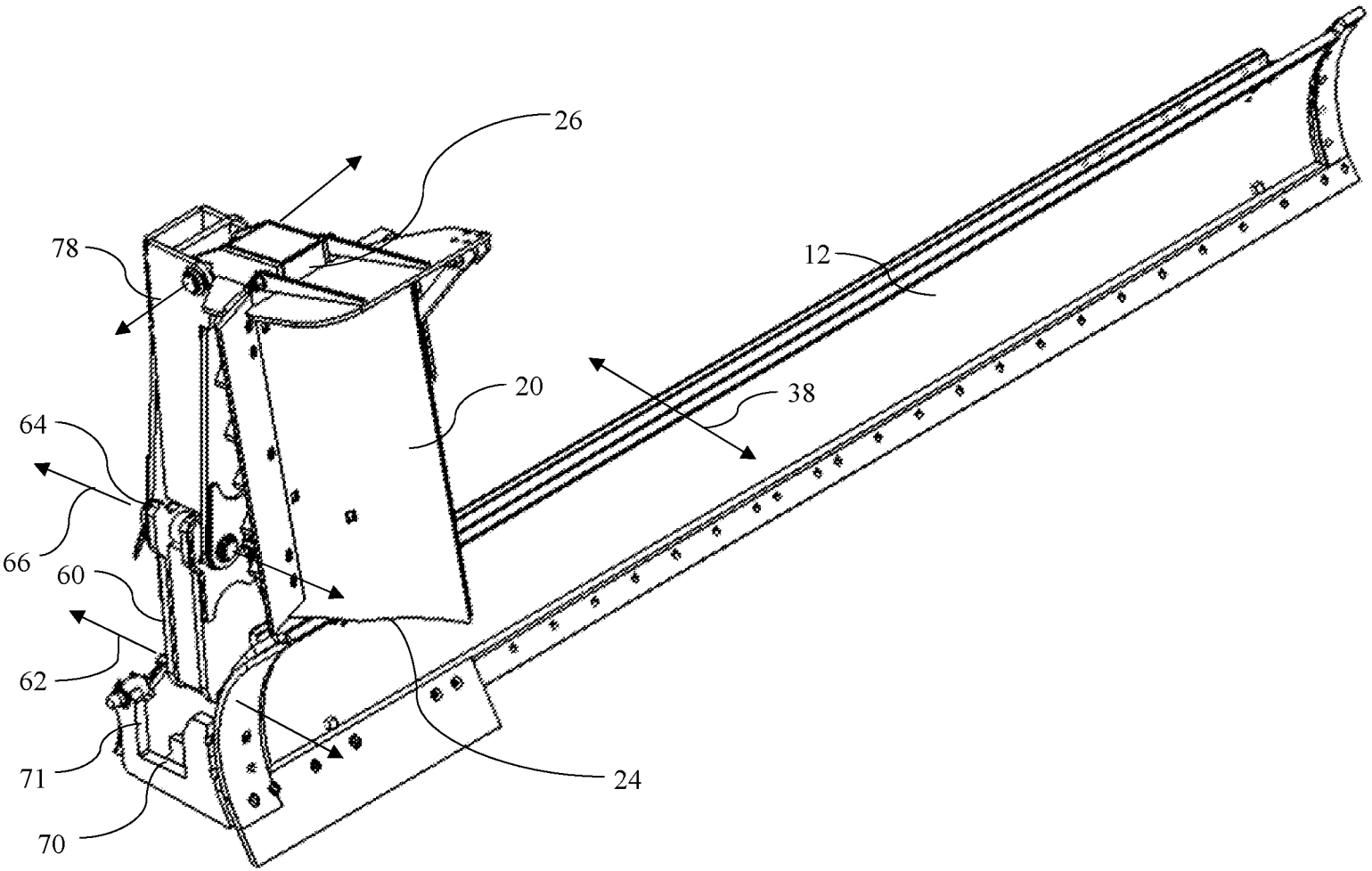
FIG. 8 is a first end view of the grading assembly of FIG. 7.

Referring to FIG. 8, in some aspects, when the shouldering moldboard 20 is in the stowed (raised) position, the first end 24 of the shouldering moldboard can be forward of the second end 26 of the shouldering moldboard along the front-to-rear axis 38. In some aspects, the second longitudinal axis of the shouldering moldboard can extend rearwardly relative to the front-to-rear axis from the first end of the shouldering moldboard to the second end of the shouldering moldboard. In some aspects, the shouldering moldboard can be pivotably coupled to the second arm 64 about a pivotal axis 78. It is contemplated that pivotal movement of the shouldering moldboard 20 about the pivotal axis 78 can enable stowing of the shouldering moldboard without interference with (e.g., crashing into) the main moldboard 12.

In some aspects, the position of the shouldering moldboard 20 about the pivotal axis 78 can be selected manually and fixed via a locking pin, clamp, or other retainer. In alternative aspects, and with further reference to FIGS. 5 and 10, the grading assembly 10 can comprise an actuator 96 (e.g., a hydraulic cylinder) that is configured to move the shouldering moldboard 20 relative to the main moldboard 12 to prevent the shouldering moldboard from interfering with the main moldboard as it is moved from the deployed position to the stowed position. For example, the actuator 96 can couple to the second arm 64 and to the shouldering moldboard 20. The actuator 96 can be configured to extend to shift the first end 24 of the shouldering moldboard forwardly along the axis 43 to move the first end 24 away from the main moldboard 12.

In some aspects, the actuator 96 can be independently operated by an operator using a switch or other operator control device. In further aspects, a controller can be configured to operate the actuator 96 to prevent interference between the shouldering moldboard 20 and the main moldboard 12. For example, upon receiving a signal (e.g., an operator-triggered signal) indicating that the shouldering moldboard is to move to the stowed position, the actuator 96 can actuate to move the shouldering moldboard about the pivotal axis 78 to shift the first end 24 of the shouldering moldboard 20 forwardly.

Referring to FIGS. 1 and 11-12, the grading assembly 10 can comprise an indicator 72 that indicates the angle between (i) a projection of the second longitudinal axis 22 into a vertical plane that includes the first longitudinal axis 14 and (ii) the first longitudinal axis. The indicator 72 can comprise a gauge 74 that is fixedly coupled to the main moldboard (e.g., via the bracket 58). The indicator 72 can further comprise a marker 76 that is fixedly coupled to the shouldering moldboard 20 and is configured to point to a location on the gauge. In use, it is contemplated that the orientation of the marker 76 can change as the angular orientation of the shouldering moldboard 20 changes. The gauge 74 can comprise a scale, such as, for example, degree or slope (pitch) markings. Thus, the indicator can indicate the angle at which the shoulder will be formed relative to the main moldboard 12 when the grading assembly travels forwardly. In further aspects, an angle tilt sensor can be configured to determine an angle of the shouldering moldboard 20. The tilt sensor can be in communication with a display, such as for example, a display of a motor grader vehicle.

In some aspects, the grading assembly 10 can couple to a vehicle to provide a grading machine. Optionally, the vehicle can be a tractor, a truck, or a specialized vehicle for grading (e.g., a motor grader). For example, motor graders are common machines that include the main moldboard 12 as described herein. Accordingly, in exemplary aspects, the components of the grading assembly 10 in addition to the main moldboard 12 (e.g., the shouldering moldboard 20, linkage 30, and actuator 32) can be provided as an attachment 11 for coupling to the main moldboard of a motor grader. For example, the attachment can comprise the shouldering moldboard, the linkage 30 that pivotably couples the shouldering moldboard to the main moldboard at the second end of the main moldboard so that the shouldering moldboard is movable relative to the main moldboard about and between a raised position and a fully deployed (lowered) position, and the actuator 32 that is configured to pivot the shouldering moldboard relative to the main moldboard by the linkage.

In some optional aspects, the main moldboard 12 can have a length along the first longitudinal axis 14 from about 12 feet to about 24 feet. In some optional aspects, the shouldering moldboard can have a length along the second longitudinal axis 22 from about 2 feet to about 5 feet. In some aspects, the second moldboard 20 can be pivotable about the second pivotal axis 66 from 0 degrees (forming a planar surface with the main moldboard 12 when moved forwardly) to negative 26.6 degrees (forming a downward slope away from the main moldboard). In exemplary aspects, the second moldboard 20 can be pivotable about the pivotal axis 78 by about ten degrees, or less than 10 degrees, or from about 5 degrees to about 10 degrees, or about 7.56 degrees.

EXEMPLARY ASPECTS

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A grading assembly comprising:

a main moldboard that is elongate along a first longitudinal axis between a first end and a second end of the main moldboard, wherein the main moldboard has a front face and an opposed rear face, wherein the grading assembly has a front-to-rear axis that is perpendicular to the first longitudinal axis and extends through the main moldboard between the front face and the opposed rear face;

a shouldering moldboard that is elongate along a second longitudinal axis between a first end and a second end of the shouldering moldboard;

a linkage that pivotably couples the shouldering moldboard to the main moldboard at the second end of the main moldboard so that the shouldering moldboard is movable relative to the main moldboard about and between a stowed position and a fully deployed position; and an actuator that is configured to pivot the shouldering moldboard relative to the main moldboard by the linkage.

Aspect 2: The grading assembly of aspect 1, wherein, in at least one position between the stowed position and the fully lowed position, the front-to-rear axis extends through the main moldboard and the shouldering moldboard.

Aspect 3: The grading assembly of aspect 1 or aspect 2, further comprising an end plate that is coupled to the shouldering moldboard and that extends forwardly from the second end of the shouldering moldboard along an axis that is perpendicular to the second longitudinal axis and extends from a rear face to a front face of the shouldering moldboard.

Aspect 4: The grading assembly of aspect 3, wherein the end plate has a proximal end and a distal end that are spaced along an end plate axis, wherein the end plate is selectively configurable to extend at a select angle relative to the second longitudinal axis of the shouldering moldboard.

Aspect 5: The grading machine of any one of the preceding aspects 1, further comprising an end plate that is coupled to the shouldering moldboard and extends outwardly from the shouldering moldboard.

Aspect 6: The grading assembly of any one of the preceding aspects, further comprising a stop that engages the linkage between the stowed position and the fully deployed position to restrict a movement of at least a portion of the linkage.

Aspect 7: The grading assembly of any one of the preceding aspects, wherein the linkage comprises:

a first arm that is pivotable relative to the main moldboard about a first pivotal axis; and a second arm that is pivotable relative to the first arm about a second pivotal axis that is spaced from the first pivotal axis along the first arm, wherein the actuator is a linear actuator that is pivotably coupled to the main moldboard about a third pivotal axis and is pivotably coupled to the second arm about a fourth pivotal axis that is spaced from the second pivotal axis along the second arm.

Aspect 8: The grading assembly of aspect 7, wherein the grading assembly comprises a stop that engages the linkage as the shouldering moldboard moves from the stowed position to the fully deployed position, wherein the stop is configured to engage the first arm to cease rotation of the first arm as the shouldering moldboard moves from the stowed position to the fully deployed position.

Aspect 9: The grading assembly of aspect 8, wherein the stop engages the first arm when the second longitudinal axis of the shouldering moldboard is within 10 degrees, plus or minus, of a plane that includes the first longitudinal axis and the front-to-rear axis.

Aspect 10: The grading assembly of any one of the preceding aspects, further comprising an indicator that is configured to indicate an angle of the first longitudinal axis of the main moldboard to the second longitudinal axis of the shouldering moldboard.

Aspect 11: The grading assembly of aspect 10, wherein the angle of the main moldboard to the shouldering moldboard indicates movement of the shouldering moldboard once the first arm engages the stop.

Aspect 12: The grading assembly of any one of the preceding aspects, wherein the linkage comprises a bracket that couples to the main moldboard.

Aspect 13: The grading assembly of any one of the preceding aspects, wherein in the stowed position, the second end of the shouldering moldboard is forward of the second end of the shouldering moldboard along the front-to-rear axis.

Aspect 14: The grading assembly of any one of the preceding aspects, wherein the second longitudinal axis of the shouldering moldboard extends rearwardly relative to the front-to-rear axis from the first end of the shouldering moldboard to the second end of the shouldering moldboard.

Aspect 15: The grading assembly of any one of the preceding aspects, wherein, in the stowed position, the second longitudinal axis is pivoted at least 90 degrees from the fully deployed position.

Aspect 16: A grading machine comprising:

a vehicle;

a grading assembly as in any one of the preceding aspects, wherein the grading assembly is coupled to the vehicle.

Aspect 17: A method of using the grading machine as in aspect 16, the method comprising moving the grading assembly along a surface to simultaneously grade a road and a shoulder.

Aspect 18: The method of aspect 17, further comprising moving, by the actuator, the shouldering moldboard relative to the moldboard.

Aspect 19: The method of aspect 17 or aspect 18, further comprising moving, by the actuator, the shouldering moldboard to the stowed position.

Aspect 20: An attachment for coupling to a main moldboard that is elongate along a first longitudinal axis between a first end and a second end of the main moldboard, wherein the main moldboard has a front face and an opposed rear face, wherein the grading assembly has a front-to-rear axis that is perpendicular to the first longitudinal axis and extends through the main moldboard between the front face and the opposed rear face, the attachment comprising:

a shouldering moldboard that is elongate along a second longitudinal axis between a first end and a second end of the shouldering moldboard;

a linkage that is configured to pivotably couple the shouldering moldboard to the main moldboard at the second end of the main moldboard so that the shouldering moldboard is movable relative to the main moldboard about and between a stowed position and a fully deployed position; and an actuator that is configured to pivot the shouldering moldboard relative to the main moldboard by the linkage.

Aspect 21: The attachment of aspect 20, wherein the linkage comprises:

a bracket that is configured to couple to the main moldboard;

a first arm that is pivotable relative to the bracket about a first pivotal axis; and a second arm that is pivotable relative to the first arm about a second pivotal axis that is spaced from the first pivotal axis along the first arm, wherein the actuator is a linear actuator that is pivotably coupled to the bracket about a third pivotal axis and is pivotably coupled to the second arm about a fourth pivotal axis that is spaced from the second pivotal axis along the second arm.

Aspect 22: The attachment of aspect 20 or aspect 21, wherein, when the attachment is coupled to the main moldboard, in at least one position between the stowed position and the fully lowed position, the front-to-rear axis extends through the main moldboard and the shouldering moldboard.

Aspect 23: The attachment of any one of aspects 20-22, wherein the shouldering moldboard has a front face and a rear face, the attachment further comprising an end plate that is coupled to the shouldering moldboard and that extends forwardly from the second end of the shouldering moldboard along an axis that is perpendicular to the second longitudinal axis in a direction from the rear face of the shouldering moldboard to the front face of the shouldering moldboard.

Aspect 24: The attachment of aspect 23, wherein the end plate has a proximal end and a distal end that are spaced along an end plate axis, wherein the end plate is selectively configurable to extend at a select angle relative to the second longitudinal axis of the shouldering moldboard.

Aspect 25: The attachment of any one of aspects 20-24, further comprising an end plate that is coupled to the shouldering moldboard and extends outwardly from the shouldering moldboard.

Aspect 26: The attachment of any one of aspects 20-25, further comprising a stop that engages the linkage between the stowed position and the fully deployed position to restrict a movement of at least a portion of the linkage.

Aspect 27: The attachment of any one of aspects 20-26, wherein the linkage comprises:

a first arm that is configured to be pivotable relative to the main moldboard about a first pivotal axis; and a second arm that is pivotable relative to the first arm about a second pivotal axis that is spaced from the first pivotal axis along the first arm, wherein the actuator is a linear actuator that is configured to be pivotably coupled to the main moldboard about a third pivotal axis and is pivotably coupled to the second arm about a fourth pivotal axis that is spaced from the second pivotal axis along the second arm.

Aspect 28: The attachment of aspect 27, wherein the grading assembly comprises a stop that engages the linkage as the shouldering moldboard moves from the stowed position to the fully deployed position, wherein the stop is configured to engage the first arm to cease rotation of the first arm as the shouldering moldboard moves from the stowed position to the fully deployed position.

Aspect 29: The attachment of aspect 28, wherein the stop engages the first arm when the second longitudinal axis of the shouldering moldboard is within 10 degrees, plus or minus, of a plane that includes the first longitudinal axis and the front-to-rear axis.

Aspect 30: The attachment of any one of aspects 20-29, further comprising an indicator that is configured to indicate an angle of the first longitudinal axis of the main moldboard to the second longitudinal axis of the shouldering moldboard.

Aspect 31: The attachment of aspect 30, wherein the angle of the main moldboard to the shouldering moldboard indicates movement of the shouldering moldboard once the first arm engages the stop.

Aspect 32: The attachment of any one of aspects 20-31, wherein the linkage comprises a bracket that is configured to couple to the main moldboard.

Aspect 33: The attachment of any one of aspects 20-32, wherein in the stowed position, the second end of the shouldering moldboard is forward of the second end of the shouldering moldboard along the front-to-rear axis.

Aspect 34: The attachment of any one of aspects 20-33, wherein the second longitudinal axis of the shouldering moldboard extends rearwardly relative to the front-to-rear axis from the first end of the shouldering moldboard to the second end of the shouldering moldboard.

Aspect 35: The attachment of any one of aspects 20-34, wherein, in the stowed position, the second longitudinal axis is pivoted at least 90 degrees from the fully deployed position.

Aspect 36: A grading machine comprising:

a vehicle; and a grading assembly comprising:

a main moldboard that is elongate along a first longitudinal axis between a first end and a second end of the main moldboard, wherein the main moldboard has a front face and an opposed rear face, wherein the grading assembly has a front-to-rear axis that is perpendicular to the first longitudinal axis and extends through the main moldboard between the front face and the opposed rear face; and an attachment as in any one of the proceeding aspects.

Aspect 37: A method of using the grading machine of aspect 36, the method comprising:

moving the grading assembly along a surface to simultaneously grade a road and a shoulder.

Aspect 38: The method of aspect 37, further comprising:

moving, by the actuator, the shouldering moldboard relative to the moldboard.

Aspect 39: The method of aspect 38, further comprising:

moving, by the actuator, the shouldering moldboard to the stowed position.

Although the foregoing invention has been described in some detail by way of illustration and example for purposes of clarity of understanding, certain changes and modifications may be practiced within the scope of the appended claims.

What is claimed is:

1. An attachment for coupling to a main moldboard that is elongate along a first longitudinal axis between a first end and a second end of the main moldboard, wherein the main moldboard has a front face and an opposed rear face, wherein the main moldboard has a front-to-rear axis that is perpendicular to the first longitudinal axis and extends through the main moldboard between the front face and the opposed rear face, the attachment comprising:

a shouldering moldboard that is elongate along a second longitudinal axis between a first end and a second end of the shouldering moldboard;

a linkage that is configured to pivotably couple the shouldering moldboard to the main moldboard at the second end of the main moldboard so that the shouldering moldboard is movable relative to the main moldboard about and between a stowed position and a fully deployed position, wherein the linkage comprises:

a first arm that is pivotable relative to the main moldboard about a first pivotal axis; and a second arm that is pivotable relative to the first arm about a second pivotal axis that is spaced from the first pivotal axis along the first arm; and an actuator that is configured to pivot the shouldering moldboard relative to the main moldboard by the linkage, wherein the actuator is a linear actuator that is pivotably coupled to the main moldboard about a third pivotal axis and is pivotably coupled to the second arm about a fourth pivotal axis that is spaced from the second pivotal axis along the second arm.

2. The attachment of claim 1, wherein, when the attachment is coupled to the main moldboard, in at least one position between the stowed position and the fully deployed position, the front-to-rear axis extends through the main moldboard and the shouldering moldboard.

3. The attachment of claim 1, wherein the shouldering moldboard has a front face and a rear face, the attachment further comprising an end plate that is coupled to the shouldering moldboard and that extends forwardly from the second end of the shouldering moldboard along an axis that is perpendicular to the second longitudinal axis in a direction from the rear face of the shouldering moldboard to the front face of the shouldering moldboard.

4. The attachment of claim 3, wherein the end plate has a proximal end and a distal end that are spaced along an end plate axis, wherein the end plate is selectively configurable to extend at a select angle relative to the second longitudinal axis of the shouldering moldboard.

5. The attachment of claim 1, further comprising an end plate that is coupled to the shouldering moldboard and extends outwardly from the shouldering moldboard.

6. The attachment of claim 1, further comprising a stop that engages the linkage between the stowed position and the fully deployed position to restrict a movement of at least a portion of the linkage.

7. The attachment of claim 1, further comprising a stop that engages the linkage as the shouldering moldboard moves from the stowed position to the fully deployed position, wherein the stop is configured to engage the first arm to cease rotation of the first arm as the shouldering moldboard moves from the stowed position to the fully deployed position.

8. The attachment of claim 7, wherein the stop engages the first arm when the second longitudinal axis of the shouldering moldboard is within 10 degrees, plus or minus, of a plane that includes the first longitudinal axis and the front-to-rear axis.

9. The attachment of claim 7, further comprising an indicator that is configured to indicate an angle of the first longitudinal axis of the main moldboard to the second longitudinal axis of the shouldering moldboard, wherein the angle of the main moldboard to the shouldering moldboard indicates movement of the shouldering moldboard once the first arm engages the stop.

10. The attachment of claim 1, further comprising an indicator that is configured to indicate an angle of the first longitudinal axis of the main moldboard to the second longitudinal axis of the shouldering moldboard.

11. The attachment of claim 1, wherein the linkage comprises a bracket that is configured to couple to the main moldboard.

12. The attachment of claim 1, wherein in the stowed position, the first end of the shouldering moldboard is forward of the second end of the shouldering moldboard along the front-to-rear axis.

13. The attachment of claim 1, wherein the second longitudinal axis of the shouldering moldboard extends rearwardly relative to the front-to-rear axis from the first end of the shouldering moldboard to the second end of the shouldering moldboard.

14. The attachment of claim 1, wherein, in the stowed position, the second longitudinal axis is pivoted at least 90 degrees from the fully deployed position.

15. A grading machine comprising:
a vehicle; and
a grading assembly comprising:
a main moldboard that is elongate along a first longitudinal axis between a first end and a second end of the main moldboard, wherein the main moldboard has a front face and an opposed rear face, wherein the grading assembly has a front-to-rear axis that is perpendicular to the first longitudinal axis and extends through the main moldboard between the front face and the opposed rear face;
a shouldering moldboard that is elongate along a second longitudinal axis between a first end and a second end of the shouldering moldboard;
a linkage that pivotably couples the shouldering moldboard to the main moldboard at the second end of the main moldboard so that the shouldering moldboard is movable relative to the main moldboard about and between a stowed position and a fully deployed position, wherein the linkage comprises:
a first arm that is pivotable relative to the main moldboard about a first pivotal axis; and
a second arm that is pivotable relative to the first arm about a second pivotal axis that is spaced from the first pivotal axis along the first arm; and
an actuator that is configured to pivot the shouldering moldboard relative to the main moldboard by the linkage, wherein the actuator is a linear actuator that is pivotably coupled to the main moldboard about a third pivotal axis and is pivotably coupled to the second arm about a fourth pivotal axis that is spaced from the second pivotal axis along the second arm.

16. A method comprising:
moving a grading machine, the grading machine comprising:
a vehicle; and
a grading assembly that is coupled to the vehicle, the grading assembly comprising:
a main moldboard that is elongate along a first longitudinal axis between a first end and a second end of the main moldboard;
a shouldering moldboard that is elongate along a second longitudinal axis between a first end and a second end of the shouldering moldboard;
a linkage that pivotably couples the shouldering moldboard to the main moldboard at the second end of the main moldboard so that the shouldering moldboard is movable relative to the main moldboard about and between a stowed position and a fully deployed position, wherein the linkage comprises:
a first arm that is pivotable relative to the main moldboard about a first pivotal axis; and
a second arm that is pivotable relative to the first arm about a second pivotal axis that is spaced from the first pivotal axis along the first arm; and
an actuator that is configured to pivot the shouldering moldboard relative to the main moldboard by the linkage, wherein the actuator is a linear actuator that is pivotably coupled to the main moldboard about a third pivotal axis and is pivotably coupled to the second arm about a fourth pivotal axis that is spaced from the second pivotal axis along the second arm; and
moving the grading assembly along a surface to simultaneously grade a road and a shoulder.

17. The method of claim 16, further comprising:
moving, by the actuator, the shouldering moldboard relative to the moldboard.

18. The method of claim 16, further comprising:
moving, by the actuator, the shouldering moldboard to the stowed position.

* * * * *